US011746449B2

(12) United States Patent
Verscheure et al.

(10) Patent No.: US 11,746,449 B2
(45) Date of Patent: Sep. 5, 2023

(54) GUIDE DEVICE FOR A RAPIER BAR AND RAPIER WEAVING MACHINE COMPRISING SUCH A GUIDE DEVICE

(71) Applicant: VANDEWIELE NV, Kortrijk/Marke (BE)

(72) Inventors: Diederik Verscheure, Bruges (BE); Brecht Halsberghe, Kuurne (BE); Geert Maes, Gullegem (BE); Koen Bruynoghe, De Pinte (BE)

(73) Assignee: VANDEWIELE NV, Kortrijk/Marke (BE)

( * ) Notice: Subject to any disclaimer, the term of this patent is extended or adjusted under 35 U.S.C. 154(b) by 178 days.

(21) Appl. No.: 17/606,748

(22) PCT Filed: May 1, 2020

(86) PCT No.: PCT/IB2020/054129
§ 371 (c)(1),
(2) Date: Oct. 26, 2021

(87) PCT Pub. No.: WO2020/225682
PCT Pub. Date: Nov. 12, 2020

(65) Prior Publication Data

US 2022/0220645 A1 Jul. 14, 2022

(30) Foreign Application Priority Data

May 7, 2019 (BE) ..... 2019/5298

(51) Int. Cl.
*D03D 47/27* (2006.01)
*D03D 47/18* (2006.01)
(Continued)

(52) U.S. Cl.
CPC ..... *D03D 47/277* (2013.01); *D03D 47/18* (2013.01); *D03D 47/273* (2013.01); *D03D 47/275* (2013.01); *D03J 1/008* (2013.01)

(58) Field of Classification Search
CPC .... D03D 47/277; D03D 47/18; D03D 47/273; D03D 47/275; D03J 1/008
See application file for complete search history.

(56) References Cited

U.S. PATENT DOCUMENTS 4,046,224 A * 9/1977 Smutny ..... D03J 1/008 139/45
4,117,869 A * 10/1978 Rushman ..... D03J 1/003 139/438
(Continued)

FOREIGN PATENT DOCUMENTS

CN 204211911 A1 3/2015
CN 208776912 A1 4/2019
(Continued)

OTHER PUBLICATIONS

Search Report for International Patent Application PCT/IB2020/225682, dated Nov. 23, 2020.

*Primary Examiner* — Robert H Muromoto, Jr.
(74) *Attorney, Agent, or Firm* — FRESH IP PLC; Clifford D. Hyra; Aubrey Y. Chen

(57) ABSTRACT

A guide device including a guide (1) with one or more guide elements (2) for guiding a rapier bar (3) in a rapier weaving machine, wherein this guide device is provided with an air circuit (5) through which compressed air can flow and which is provided with perforations (7) for cooling the rapier bar (3) by compressed air, and wherein this guide device is provided with a cooling circuit (8) through which coolant can flow for cooling the rapier bar (3) by coolant. In
(Continued)

addition, an assembly of a rapier bar (3), drive (4) and such a guide device. Furthermore, a rapier weaving machine including such an assembly.

21 Claims, 6 Drawing Sheets

(51) Int. Cl.
*D03D 49/50* (2006.01)
*D03J 1/00* (2006.01)

(56) References Cited

U.S. PATENT DOCUMENTS 4,520,848 A * 6/1985 Lucian ..... D03J 1/003 139/45
5,097,873 A * 3/1992 Muller ..... D03D 47/277 139/449
5,601,121 A * 2/1997 Bonacina ..... D03D 47/275 74/89.32
5,727,601 A * 3/1998 Krumm ..... D03D 47/273 139/1 R
5,950,686 A * 9/1999 Herrlein ..... D03D 47/276 384/99
6,733,271 B2 * 5/2004 De Nichilo ..... B29C 51/262 425/388
6,820,655 B2 * 11/2004 Beeh ..... D03J 1/002 139/1 C
6,988,516 B2 * 1/2006 Debaes ..... D03D 47/275 139/447
9,209,665 B2 * 12/2015 Casazza ..... H02K 1/32
RE46,469 E * 7/2017 Dunn, Jr. ..... H05K 5/0013
2002/0136793 A1 * 9/2002 De Nichilo ..... B29C 51/262 425/445

FOREIGN PATENT DOCUMENTS

EP 0866156 A1 9/1998
WO WO2016/134973 A1 9/2016

* cited by examiner

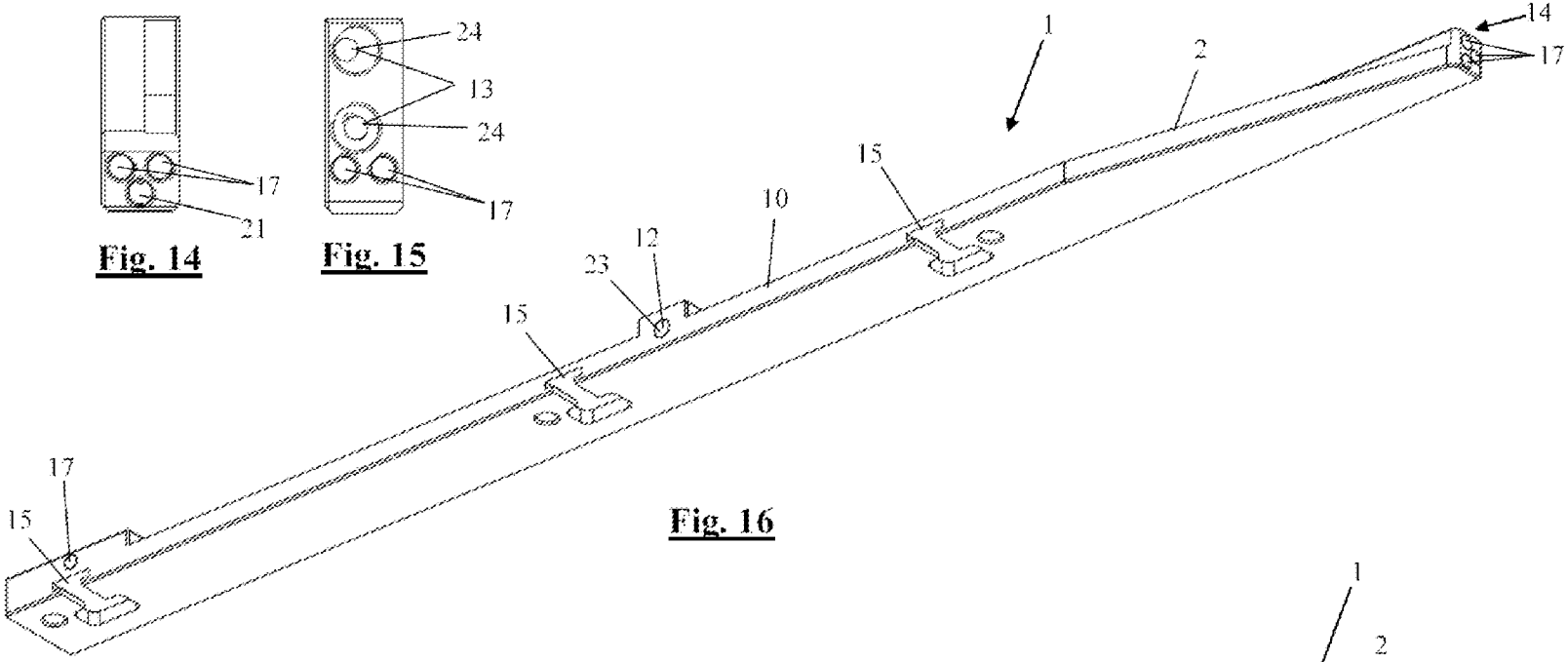
Fig. 16
Fig. 15
Fig. 14
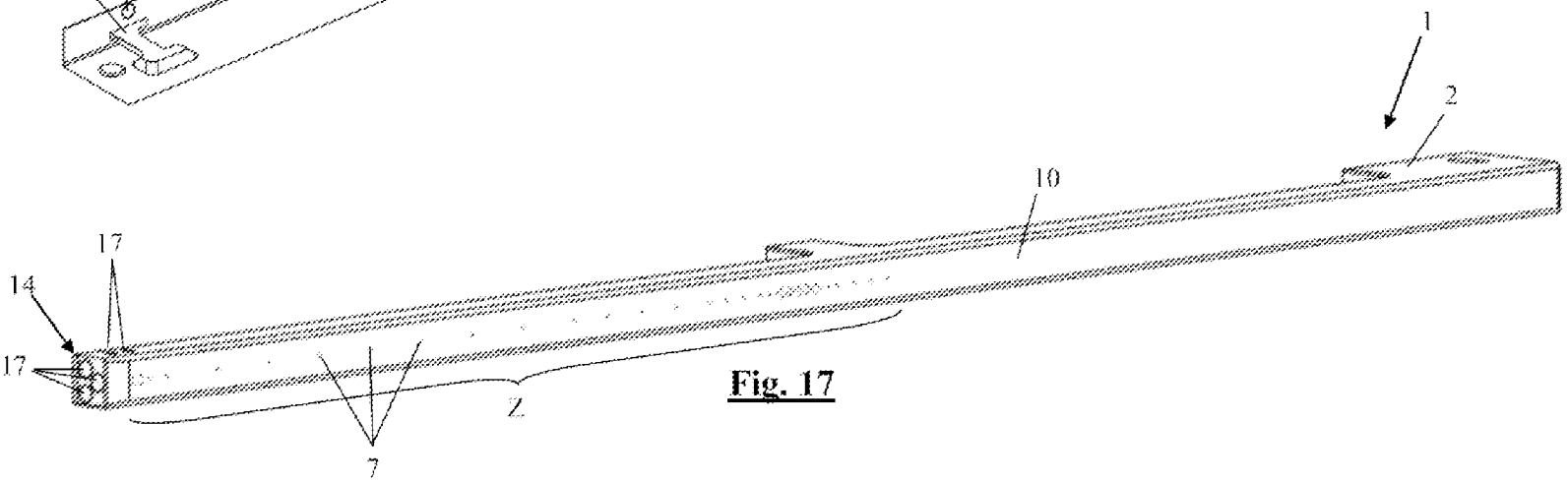
Fig. 17

GUIDE DEVICE FOR A RAPIER BAR AND RAPIER WEAVING MACHINE COMPRISING SUCH A GUIDE DEVICE

FIELD OF THE DISCLOSURE

The present disclosure relates to a guide device comprising a guide with one or more guide elements for guiding a rapier bar in a rapier weaving machine, wherein this guide device is provided with an air circuit through which compressed air can flow and which is provided with perforations for cooling the rapier bar by means of compressed air.

In addition, the present disclosure relates to an assembly of a rapier bar, drive means for driving this rapier bar and such a guide device.

Furthermore, the present disclosure relates to a rapier weaving machine comprising such an assembly.

BACKGROUND

Rapier weaving machines comprise one or more rapiers for introducing weft yarns in a shed between warp yarns in order to form a fabric. In this case, the rapiers take the weft yarns to transfer means which may, for example, consist of a second rapier. In order to be able to receive the weft yarns in a reliable manner, the rapiers have to be accurately positioned during this transfer. These rapiers are fitted to rapier bars and are moved through the shed by means of this rapier bar in the rapier weaving machine. The movement of this rapier bar is in this case guided by means of one or more guide elements in order to be able to accurately position the rapier bar.

Such one or more guide elements together form a guide for this rapier bar. Such a guide is provided for each rapier in a rapier weaving machine. This guide is accommodated in a guide device which in addition also comprises a support structure for this guide. In a rapier weaving machine in which several rapiers are introduced in the shed on the same side of the fabric, such a guide device may comprise for each rapier such a guide with one or more guide elements or a guide device with such a guide with one or more guide elements may be provided for each rapier. The one or more guide elements which form the guide, are the parts of such a guide device which are arranged adjacent to the movement trajectory of the rapier bar and may come into contact with this rapier bar when the rapier bar is moved. In this case, these one or more guide elements delimit the movement trajectory of the rapier bar in one or more directions at right angles to this movement trajectory.

Various kinds of such guide elements are known. In the past, such guide elements often consisted of guide rollers.

However, when guiding the rapier bar, this rapier bar heats up due to the friction with the guide elements. When a rapier bar is guided using guide rollers, it is difficult to limit the heating up of such a rapier bar. EP 0 866 156 B1 therefore proposes to provide a fixedly arranged guide element with an air circuit through which compressed air can flow and which is provided with perforations for mounting and cooling the rapier bar using compressed air. In this case, the perforations are provided in a plane of the rapier element which faces the rapier bar when guiding this rapier bar.

However, at increased weaving speeds, cooling guide elements using compressed air as described in EP 0 866 156 B1 no longer suffices.

In order to be able to make them more lightweight yet still strong, more recent rapier bars are typically also made from materials which are less well able to conduct heat, as a result of which there is a greater need to cool these rapier bars.

SUMMARY

It is the object of the present disclosure to provide a guide element by means of which a rapier bar may be guided sufficiently and by means of which it is possible to ensure cooling of the rapier bar more satisfactorily, even at relatively high weaving speeds.

This object of the disclosure is achieved by providing a guide device comprising a guide with one or more guide elements for guiding a rapier bar in a rapier weaving machine, wherein this guide device is provided with an air circuit through which compressed air can flow and which is provided with perforations for cooling the rapier bar using compressed air, and wherein this guide device is provided with a cooling circuit through which coolant can flow for cooling the rapier bar using coolant.

By means of a combination of both cooling by means of compressed air and cooling by means of a coolant, it is possible to sufficiently limit warming up of this rapier bar by friction even at relatively high weaving speeds. The rapier bar may be guided sufficiently to ensure more accurate positioning of the rapier and be cooled sufficiently to reduce warming up thereof.

The perforations for passing through compressed air in order to cool down the rapier bar are preferably provided in the guide. Preferably, these perforations are in this case provided in a surface which faces the rapier bar when guiding the rapier bar, as is the case in the prior art.

Preferably, the guide extends along a longitudinal direction for guiding the rapier bar and the guide device comprises at least one air-guiding zone, in which the perforations are arranged, wherein this air-guiding zone is provided in the guide and, viewed in the longitudinal direction, extends along a smaller length than this guide.

By limiting the air cooling to one or more discrete air-guiding zones, it is possible to reduce the cost for cooling the rapier bar using compressed air. In order to position the rapier bar accurately, however, guidance across a larger zone than the zone in which this rapier bar is in this case cooled with compressed air is desired.

Preferably, the air circuit is coupled to the compressed air device of the rapier weaving machine in which the guide device is accommodated.

Preferably, the air circuit in the guide is limited to one guide element, so that the number of couplings with compressed air lines (from other parts of the air circuit or the compressed air device) is limited.

In one or more air-guiding zones and/or in the zones next to these air-guiding zones, cooling by means of compressed air may, where necessary, be supplemented by cooling by means of coolant.

Water or a water-based liquid are preferably chosen as coolant.

The cooling circuit preferably forms part of a water cooling circuit of the rapier weaving machine in which the guide device is accommodated.

The cooling circuit preferably extends along virtually the entire length of the guide, viewed in the longitudinal direction of the guide.

The cooling circuit may be arranged at least partly in the guide, but may also be arranged at least partly outside this guide in the guide device, for example in the support structure of the guide device, such as for example in a beam adjacent to the rapier bar.

Said air circuit and/or said cooling circuit may be formed in several ways in the one or more guide elements. It is, for example, possible to provide these by drilling channels into these guide elements or by 3D-printing these guide elements, with the air circuit and/or the cooling circuit being provided herein as recesses.

Drilling greatly increases the selection of materials from which a guide element may be produced.

3D-printing makes it possible to intertwine channels from which the air circuit is formed with channels from which the cooling circuit is formed, in which case an overlapping zone in which both cooling with compressed air and cooling with coolant are provided may be used to the greatest possible extent.

Instead of forming the air circuit and/or the cooling circuit by drilling or 3D-printing, a guide element from a guide device according to the present disclosure may, for example, also be produced via extrusion or pultrusion, with the necessary channels being provided in this guide element in order to form (if desired together with other guide elements or other parts of the guide device) the cooling circuit and the air circuit.

There are several materials which are suitable for forming the one or more guide elements thereby. The material (or the materials) of a guide element is (are) selected, on the one hand, in order to be able to ensure good guidance and, on the other hand, to be able to ensure good cooling. In order to ensure good cooling, a good heat-conducting material is preferably selected. To this end, these one or more guide elements may be made, for example, from steel, aluminium, bronze, magnesium, etc.

In a more particular embodiment of a guide device according to the present disclosure, the guide comprises exactly one guide element.

If, in this case, the air circuit is provided in a said air-guiding zone, then this air-guiding zone preferably extends along a length which is virtually half the length along which the guide element extends. In this way, it is possible to achieve a good balance between, on the one hand, good guidance and, on the other hand, good cooling with limited costs for compressed air. This length is viewed in a longitudinal direction along the direction of the movement trajectory of the rapier bar. The guide element preferably substantially extends in this longitudinal direction.

In embodiments with exactly one guide element, this guide element is preferably fixedly arranged in the guide device. A fixedly arranged guide element may be coupled to a compressed air device more easily.

In another more particular embodiment, the guide comprises several guide elements.

With a guide comprising several guide elements, at least one of these guide elements is preferably configured as an air-guide element, in which a said air-guiding zone is arranged.

By providing several guide elements and configuring at least one of them as an air-guide element, it is easier to adapt such a guide to be accommodated in different types of rapier weaving machines and in this case also guide different types of rapier bars. Depending on the rapier weaving machine and/or rapier bar, the movement trajectory of the rapier bar may have to be guided, for example, for a relatively short or a relatively long section in order to be able to ensure a more accurate positioning of the rapier. In this case, a respective air-guide element may be supplemented with one or more additional guide elements in order to form the guide together. These one or more additional guide elements may be produced in a less expensive way than this air-guide element. If desired, the air-guide element may, for example, be made from a different material than the one or more additional guide elements.

Preferably, the guide comprises one or more subcircuits of the cooling circuit, so that the necessary cooling may be provided as close as possible to the rapier bar and in locations where this is most desirable due to the friction during guiding of the rapier bar.

In embodiments comprising several guide elements, preferably several of these guide elements each comprise a subcircuit of the cooling circuit in order to ensure the necessary cooling.

Still more preferably, these subcircuits are then mutually coupled by one or more couplings which are arranged substantially outside the guide. Using such external couplings makes it easier to ensure the tightness of the couplings. When guide elements are directly connected to each other and the subcircuits in this case are also directly connected to each other, it is more difficult to ensure the tightness.

Preferably, such external couplings which are arranged substantially outside the guide are in this case produced by means of flexible lines.

In one embodiment comprising several guide elements, several guide elements are preferably at least partly arranged behind each other, viewed in the longitudinal direction of the guide (the direction of the movement trajectory of the rapier bar). Several guide elements together may form one continuous guide. Alternatively, one or more such guide elements may be arranged at an intermediate distance apart. By arranging guide elements at an intermediate distance apart, distributed along the longitudinal direction, the zone in which the rapier bar may be heated by friction may be limited, while still guiding the rapier bar over a relatively long distance.

In a more particular embodiment, at least one of the guide elements is arranged in the guide device so as to be displaceable along the longitudinal direction.

By providing a guide element so as to be displaceable, the contact zone between the guide and the rapier bar may be limited while still guiding this rapier bar for as long a distance as possible.

If one of the guide elements of such an embodiment is configured as an air-guide element, then this air-guide element is preferably fixedly arranged in the guide device.

The object of the present disclosure is in addition also achieved by providing an assembly of a rapier bar, drive means for driving this rapier bar and a guide device comprising a guide with one or more guide elements for guiding this rapier bar, wherein this guide device is provided with an air circuit through which compressed air can flow and which is provided with perforations for cooling the rapier bar by means of compressed air, and wherein this assembly is provided with a cooling circuit through which coolant can flow for cooling the rapier bar by means of coolant.

In this case, the cooling circuit is preferably as close as possible to the rapier bar to be cooled.

The cooling circuit of such an assembly according to the present disclosure preferably forms part of the guide device.

This guide device is preferably configured as an above-described guide device according to the present disclosure.

The drive means of an assembly according to the present disclosure may be produced in various ways. These may for example comprises a gear wheel, in which the rapier bar comprises a gear rack in which this gear wheel engages.

Preferably, the guide of the guide device is arranged at least partly at the location of the drive means. If these drive means comprise a said gear wheel, the guide is preferably arranged at the location of this gear wheel, preferably on a side of the rapier bar opposite the side in which the gear wheel engages in the gear rack of the rapier bar.

If the guide device of an assembly according to the present disclosure comprises a said air-guiding zone, this air-guiding zone preferably extends at least at the location of the drive means.

In this case, the air-guiding zone preferably extends on one side of the drive means along the length of the guide, viewed in the longitudinal direction.

In a particular embodiment of an assembly according to the present disclosure, the guide comprises several guide elements, of which at least one guide element is a guide element in which the cooling circuit partly extends and which is arranged on a side of the rapier bar which is opposite the side of the rapier bar on which the other guide elements are arranged.

The object of the present disclosure is furthermore also achieved by providing a rapier weaving machine for weaving a fabric which comprises an above-described assembly according to the present disclosure.

In this case, the rapier weaving machine preferably comprises a central compressed air device by means of which the air circuit of the assembly is coupled.

Furthermore, the rapier weaving machine preferably comprises a central cooling circuit of which the cooling circuit of the assembly forms part.

If the assembly of a rapier weaving machine according to the present disclosure comprises a guide device with an abovementioned air-guiding zone, this air-guiding zone extends on the side of the fabric to be woven, preferably at least at the end of the guide.

At the point where the rapier bar leaves the guide, this rapier bar specifically typically experiences a great deal of friction. By allowing the air-guiding zone to extend up to this point, it is possible to limit this friction.

If the air-guiding zone extends on one side of the drive means along the remaining length of the guide, as described above, then this side is preferably turned towards the fabric to be woven.

In order to limit warming up at the location of the point where the rapier bar leaves the guide even more, the assembly of a rapier weaving machine according to the present disclosure preferably is an above-described assembly of which the at least one guide element in which the cooling circuit partly extends and which is arranged on the side of the rapier bar opposite the side of the rapier bar on which the other guide elements are arranged, is arranged near the end of the guide on the side of the fabric to be woven.

BRIEF DESCRIPTION OF THE FIGURES

The present disclosure will now be explained in more detail by means of the following description of a preferred embodiment of a guide device for a rapier bar according to the present disclosure. The sole aim of this description is to provide illustrative examples and to indicate further advantages and features of the disclosure, and can thus not be interpreted as a limitation of the area of application of the disclosure or of patent rights defined in the claims.

In this description, reference numerals are used to refer to the attached drawings, in which:

FIG. 14 shows a third guide for a guide device according to the present disclosure in front view;

FIG. 15 shows the guide from FIG. 14 in rear view;

FIG. 16 shows the guide from FIG. 14 in perspective, viewed from the top;

FIG. 17 shows the guide from FIG. 14 in perspective, viewed from the bottom.

DETAILED DESCRIPTION

Figure 1:
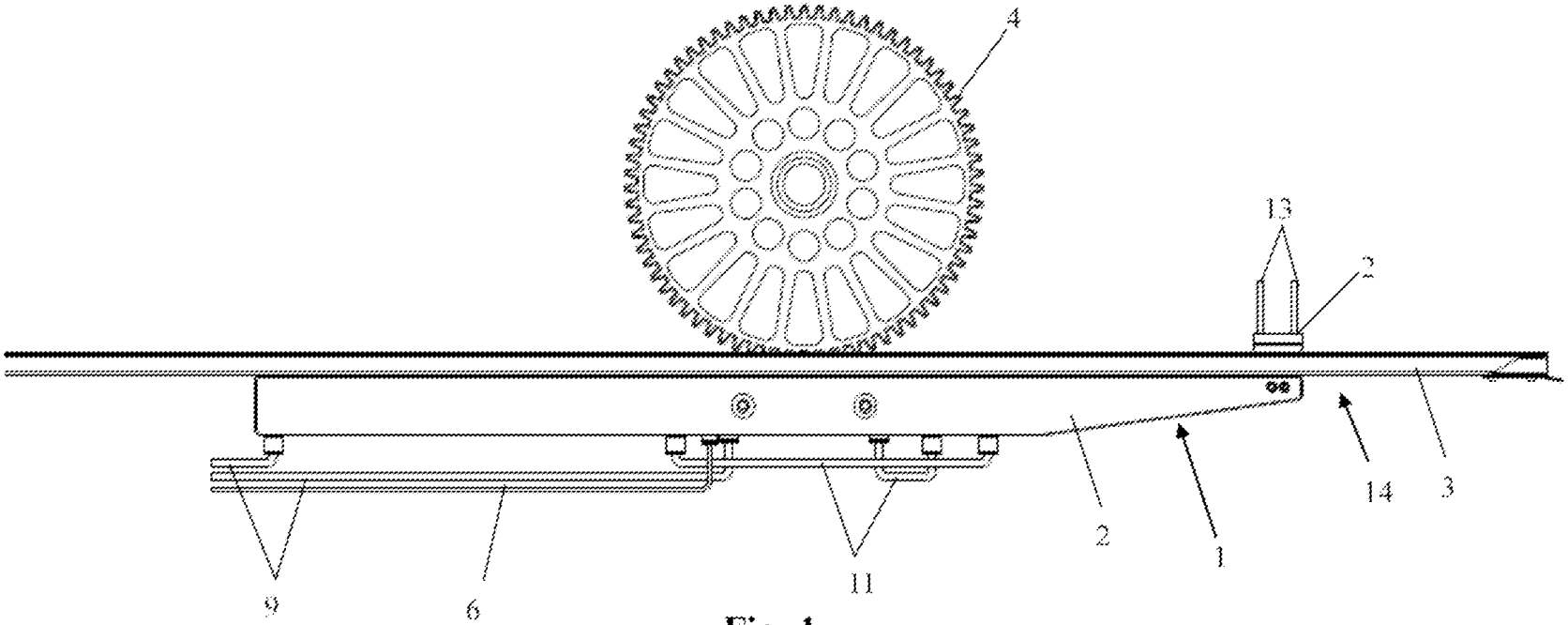
FIG. 1 shows a first guide for a guide device according to the present disclosure in side view, together with a rapier bar which is guided thereby and a toothed drive wheel for driving this rapier bar.

In this detailed description, the terms front, rear, top, bottom and side refer to the respective side of the guide (1), viewed in a rapier weaving machine, with respect to a fabric which is woven therewith, which extends substantially horizontally during weaving. In this case, a front view is a view of this guide (1) seen from the fabric. The illustrated guides (1) may be rotated through 90° or 180° in other types of rapier weaving machines and/or for guiding a second rapier bar (3) in a double-face weaving machine.

In the figures, various embodiments of guides (1) of guide devices according to the present disclosure are illustrated. By means of each of these guides (1), the movement of a corresponding rapier bar (3) in a rapier weaving machine may be guided.

In addition to the illustrated guide (1), corresponding guide devices also comprise a support structure (not shown) by means of which this guide (1) is attachable to a rapier weaving machine. In order to be able to attach the guides (1) to the support structure, each of these guides (1) is provided with mounting slots (15).

Furthermore, these guide devices may also comprise one or more additional corresponding guides (1) for guiding one or more additional rapier bars (3).

By means of the illustrated guides (1), the movement trajectory of a rapier bar (3) in a rapier weaving machine is guided. In this case, the rapier bar (3) is driven in the rapier weaving machine by means of drive means (4) to introduce a rapier with a weft yarn in a shed between warp yarns in order to form a fabric. In the embodiment illustrated in FIG. 1, the rapier bar (3) is to this end provided with a gear rack and the drive means comprise a gear wheel (4) which engages in this gear rack. Alternatively, it would, for example, also be possible to provide a flexible rapier band which bends around the gear wheel instead of such a rapier bar (3).

In the illustrated embodiments, the movement trajectory of the rapier bar (3) is guided by the guide (1) on only one side. In this case, this is the side opposite the side on which the gear wheel (4) engages with the rapier bar (3). In alternative embodiments, it is also possible to guide the movement trajectory of the rapier bar (3) on several sides.

If a said rapier band is provided instead of the illustrated rapier bar, the movement trajectory only has to be provided for the part of the illustrated guide (1) between the gear wheel (4) and the fabric. Additional cooling may then also be provided in the complete arc where the gear wheel (4) and the rapier band engage with each other.

In the first embodiment which is illustrated in FIGS. 1-7, the guide (1) comprises a first guide element (2) which is configured as an air-guide element (10) and a second guide element (2) in which this air-guide element (10) is accommodated. To this end, this second guide element (2) is provided with a receiving cavity (20) corresponding with the air-guide element (10). In the mounted position, a front part (18) of this second guide element (2) extends in front of the air-guide element (10) and a rear part (19) of this second guide element (2) extends behind the air-guide element (10).

Instead of accommodating the air-guide element (10) in a cavity (20) in such a second guide element (2), it would also be possible to attach one or more separate guide elements (2) in front of and/or behind the air-guide element (10) in order to form an alternative guide (1). In this case, such separate guide elements (2) may be securely fitted with respect to the air-guide element (10) or be arranged so as to be displaceable with respect to this air-guide element (10). In this case, these may be arranged so as to adjoin the air-guide element (10) or may be arranged at an intermediate distance from this air-guide element (10). One or more of such separate guide elements (2) may also be configured as an air-guide element (10).

In addition to said two guide elements (2), the guide (1) in the first embodiment also comprises a third guide element (2) which, in the mounted position, as illustrated in FIG. 1, is arranged on the side of the guide rod (3) opposite the other guide elements (2) of this guide.

By designing the guide (1) in the form of various guide elements (2), it is possible to produce one guide element (2) (in the illustrated first embodiment the air-guide element) for different types of guides (1) in an identical manner, while it is also possible to produce different types of guides (1) by supplementing this guide element (2) with other guide elements, for example having different cooling options and/or different dimensions and/or different guiding options, etc.

In the second embodiment, which is illustrated in FIGS. 8-13, and in the third embodiment, which is illustrated in FIGS. 14-17, the guide (1) comprises exactly one guide element (2). This guide element (2) is provided for guiding a rapier bar (3) in a similar way to the guide (1) from FIG. 1 without an additional guide element (2) which is arranged on a side of the rapier bar (3) opposite the other guide elements (2). However, in alternative embodiments, this guide element (2) could also be supplemented with such an additional guide element (2). The illustrated guide element (2) is configured as an air-guide element (10).

In the illustrated embodiments, the guides (1) are provided to be fixedly arranged in a rapier weaving machine. In alternative embodiments, it is also possible to arrange one or more guide elements (2) of such a guide (1) so as to be displaceable in a direction along the movement trajectory of the rapier bar (3), so that the movement trajectory of this rapier bar (3) may be guided over a longer distance.

Each illustrated air-guide element (10) is provided with an air circuit (5) which is produced by the following:

- drilling a main channel (21) in the longitudinal direction of the air-guide element (10) via the front side (second and third embodiment) or rear side (first embodiment) of the corresponding air-guide element (10) and closing this main channel (21);
- optionally, via the side wall of this air-guide element (10), drilling side channels (22) which end in this main channel (21) and closing these side channels (22) (first embodiment);
- drilling, via the top side of this air-guide element (10), an access channel (23) which ends in the main channel (21); and
- drilling, via the bottom side of this air-guide element (10), channels (7) which end in the main channel (21) (second and third embodiment) and/or the side channels (22) (first embodiment) and which form perforations (7) in the bottom side of the air-guide element (10).

Alternatively and/or additionally, such channels (21, 22, 23, 7) could also be 3D-printed and/or be produced via extrusion and/or pultrusion.

Instead of producing perforations (7) when drilling channels, it would also be possible to provide one or more relatively large apertures in the underside of the guide element (2) which connect to one or more compressed-air channels in this guide element (2). A membrane may be attached in such apertures which is provided with the necessary perforations.

In the illustrated embodiments, a connection (12) is provided on the access channel (23) in order to couple the air-guide element (10) with the central compressed-air device of the rapier weaving machine. When forcing compressed air through the resulting air circuit by means of the central compressed-air device, air is thus forced through the perforations (7) in order to cool the rapier bar (3) by means of this compressed air.

Figures 2, 3, 4, 5:
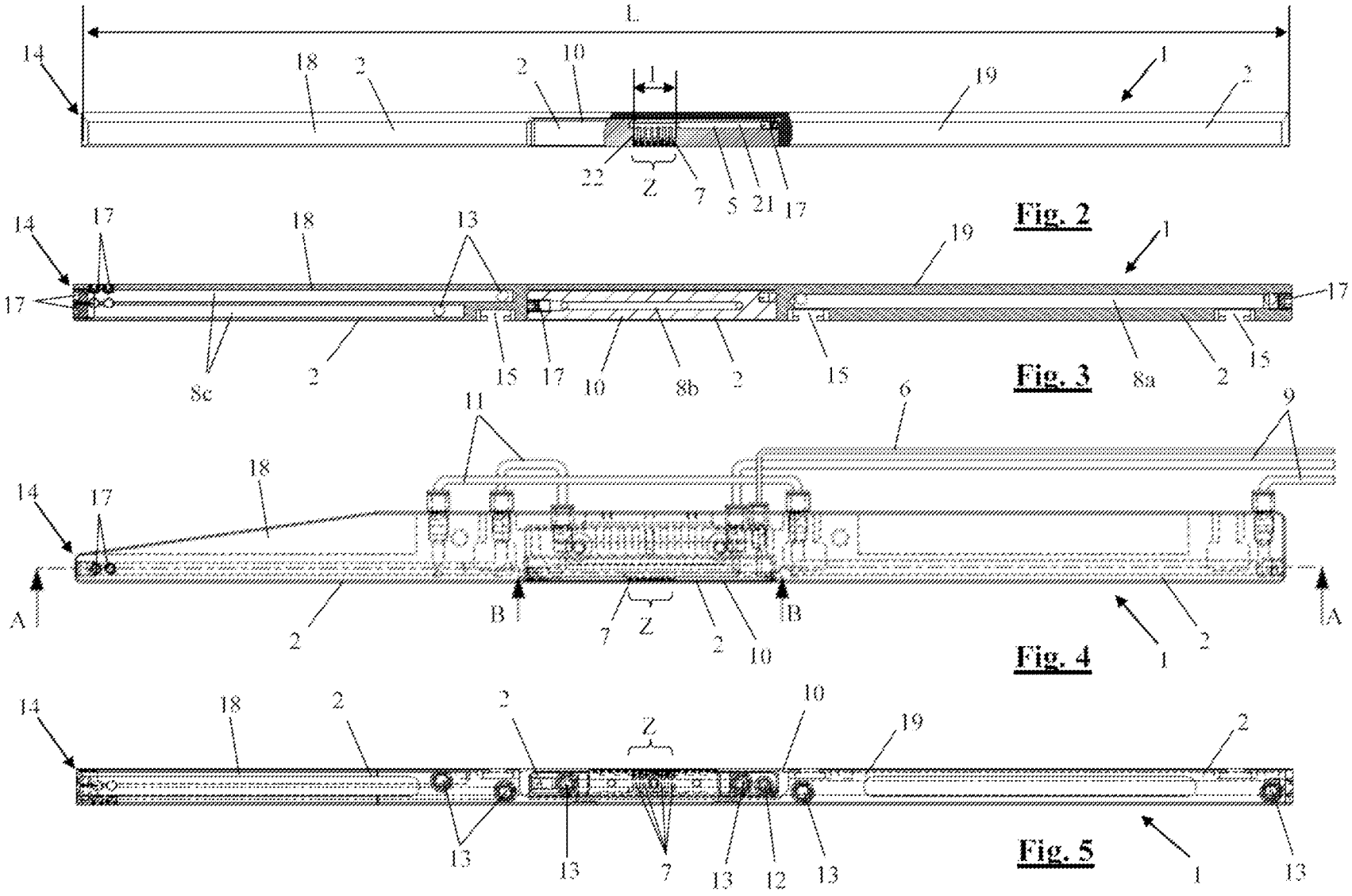
FIG. 2 shows the part of the guide from FIG. 1 which is arranged on the side of the rapier bar opposite the side in which the toothed drive wheel engages, separately in bottom view and partly in longitudinal section, cut through at the location of the air circuit along BB in FIG. 4.
FIG. 3 shows the part from FIG. 2 of the guide from FIG. 1 separately, in longitudinal section, cut through the cooling circuit along AA in FIG. 4.
FIG. 4 shows the part from FIG. 2 of the guide from FIG. 1 separately in side view, in which dashed lines illustrate the cooling circuit and the air circuit.
FIG. 5 shows the part from FIG. 2 of the guide from FIG. 1 separately in top view, in which dashed lines illustrate the cooling circuit and the air circuit.
Figure 6:
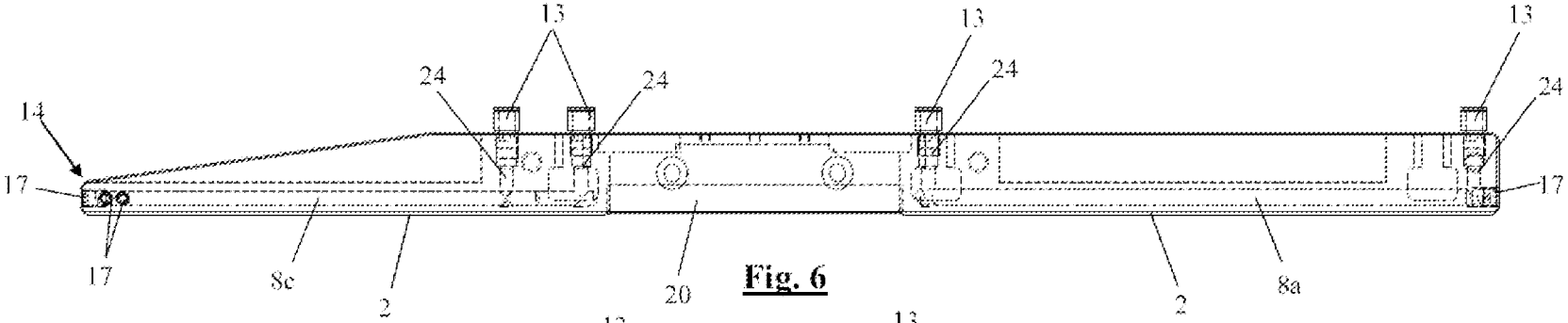
FIG. 6 shows a first guide element of the guide from FIG. 1 separately in side view, in which dashed lines illustrate a subcircuit.
Figure 7:
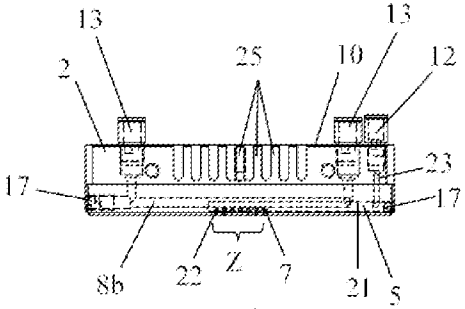
FIG. 7 shows a second guide element of the guide from FIG. 1 which is configured as an air-guide element, separately in side view, in which dashed lines illustrate a subcircuit and the air circuit.
Figure 8:
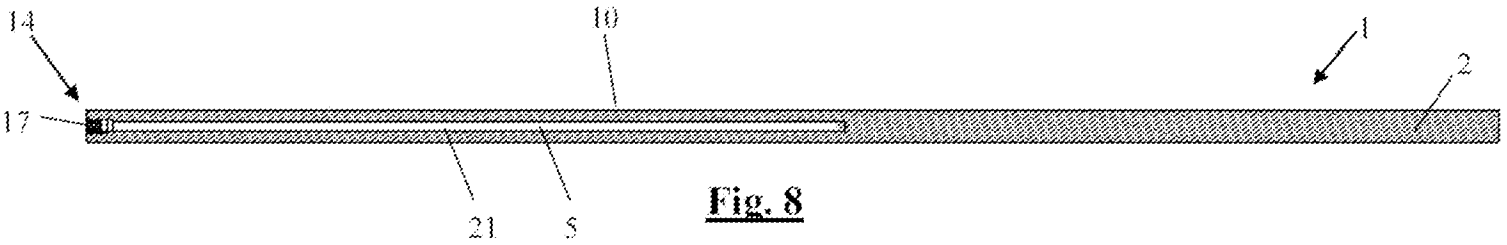
FIG. 8 shows a second guide for a guide device according to the present disclosure in longitudinal section, cut through the air circuit along BB in FIG. 11.
Figure 9:
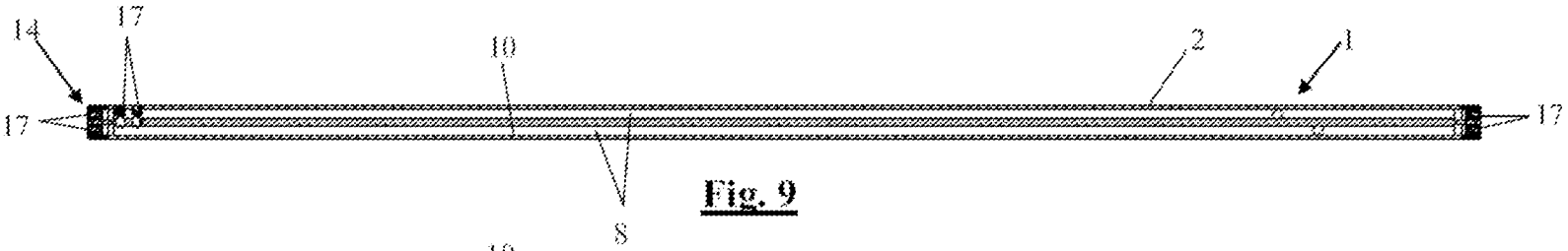
FIG. 9 shows the guide from FIG. 8 in longitudinal section, cut through the cooling circuit along AA in FIG. 11.
Figure 10:
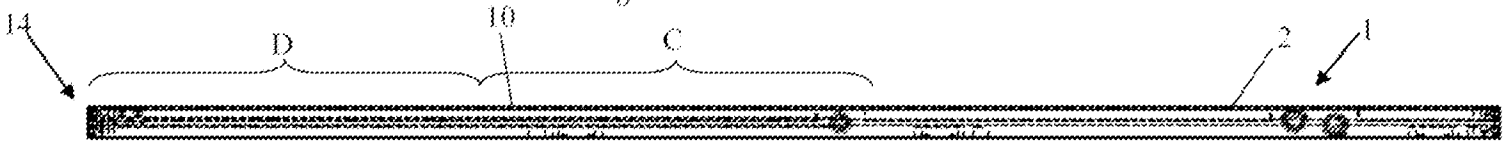
FIG. 10 shows the guide from FIG. 8 in bottom view, in which dashed lines illustrate the cooling circuit and the air circuit.
Figure 11:
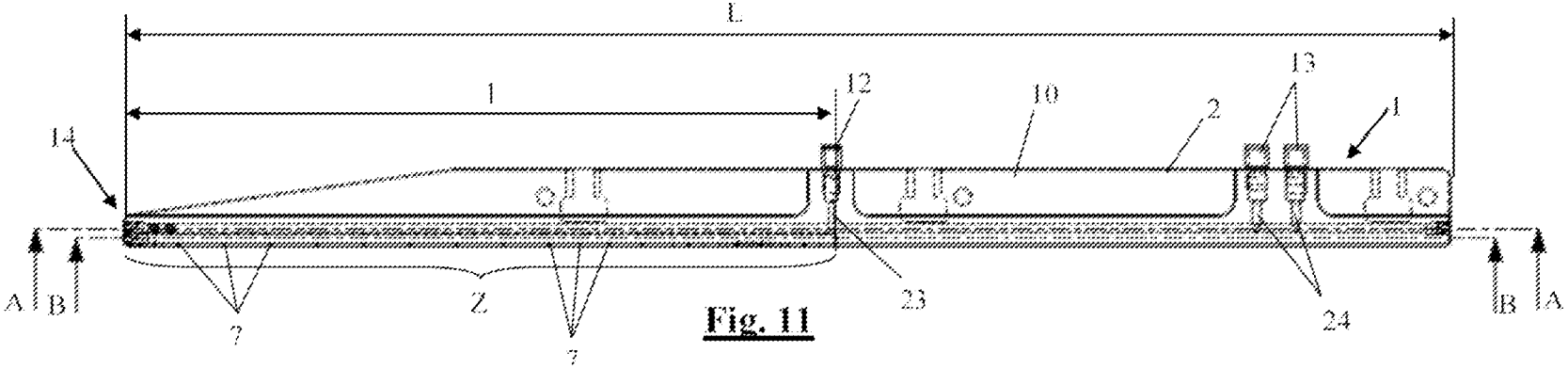
FIG. 11 shows the guide from FIG. 8 in side view, in which dashed lines illustrate the cooling circuit and the air circuit.
Figure 12:
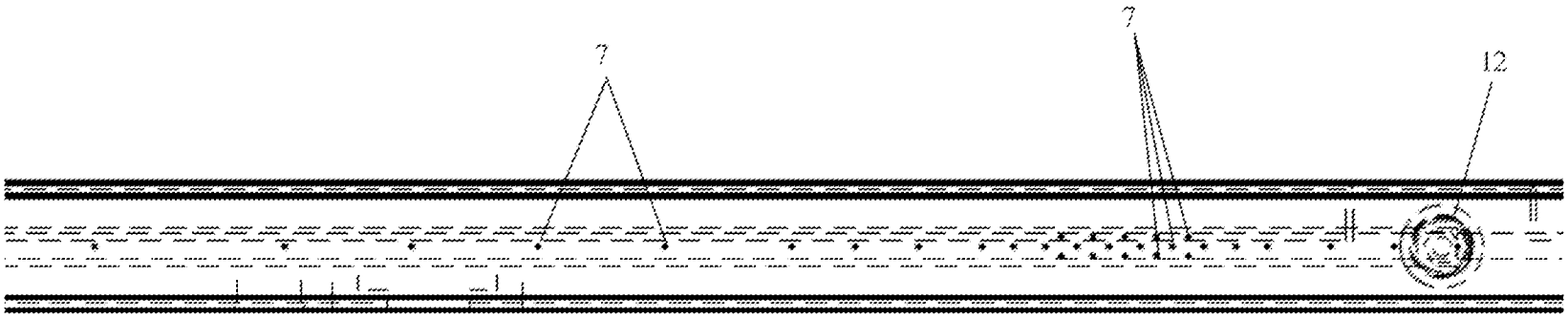
FIG. 12 shows the part C of the bottom view from FIG. 10 in more detail.
Figure 13:
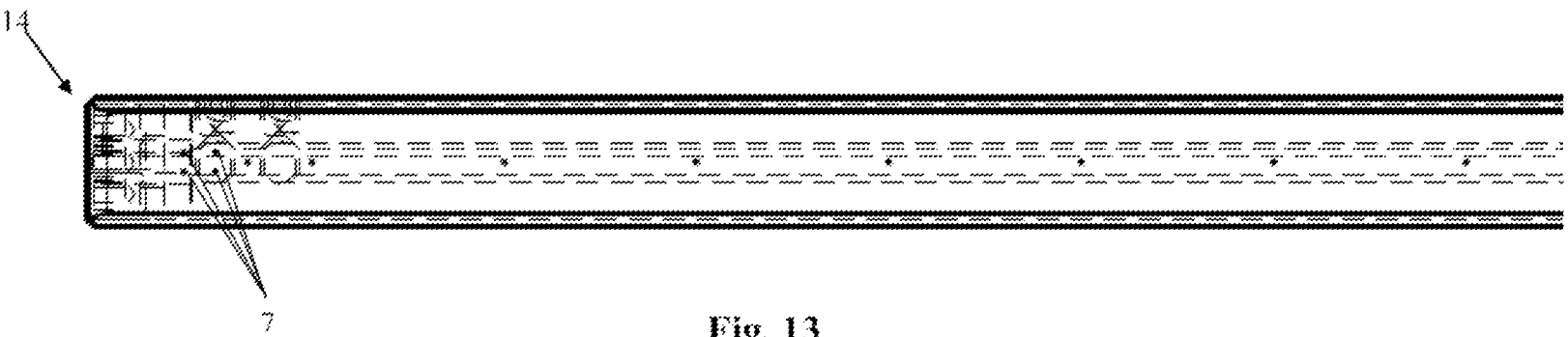
FIG. 13 shows the part D of the bottom view from FIG. 10 in more detail.

The access channel (23) is preferably provided as close as possible to the rear side of the corresponding guide element (10), so that the connection (12) with the central compressed-air device may be provided as close as possible to this central compressed-air device. In FIG. 4, the connection (12) is coupled to a compressed-air line (6) in order to couple it to the central compressed air device.

In the various embodiments, the perforations (7) are arranged in an air-guiding zone (Z) which has a shorter length (1) than the length (L) along which the guide (1) extends.

In the first embodiment, several rows and columns of these perforations (7) are arranged centrally in an air-guiding zone (Z) in the bottom surface of the air-guide element (10). In this embodiment, this air-guiding zone (Z) is situated at the location of the gear wheel (4).

In the second and in the third embodiment, the length 1 of the air-guiding zone (Z) is virtually half the length (L) of the guide. In these embodiments, in each case, on the one hand, at the location of the gear wheel (4) a larger concentration of these perforations is present and, on the other hand, at the location of the end (14) of the guide (1) on its front side, as may be seen in FIGS. 12, 13 and 17. These are parts of the guide (1) where the friction with the rapier bar (3) is greater than in the other parts of the guide (1).

Furthermore, several water channels (17) are drilled into each illustrated guide element (2) via the ends and side walls of these guide elements (2) and these water channels (17) are closed. Furthermore, access channels (24) to these water channels (17) are drilled in order together to form a water circuit (8) in this guide element (2). In this case, subcircuits (8*a*, 8*b*, 8*c*) are formed in each case in the first embodiment which are mutually couplable to external couplings (11), as may be seen in FIG. 4, in order together to form a water circuit (8) in the guide (1). In the second and the third embodiment, one single water circuit (8) is provided.

In the illustrated embodiments, the water circuit (8) in each case extends over virtually the entire length (L) of the guide (1).

Instead of drilling the water channels (17) and the access channels (24), these may alternatively and/or additionally also be 3D-printed and/or be produced via extrusion and/or pultrusion.

Each of the water circuits (8) is provided with two connections (13) in order to be able to couple this water circuit (8) with water lines (9) (see FIG. 4) in order to incorporate this in the central water circuit of the rapier weaving machine. These connections (13) are preferably provided as close as possible to the rear side of the guides (1) in order thus to keep the connections with the central water circuit as far as possible from the fabric to be woven. In order to reduce the risk of the fabric becoming caught thereon, these connections (13) are preferably arranged in the rear side of the guide (1), as is the case with the third embodiment. Both connections (13) may interchangeably be used as an inlet or as an outlet for the water circuit (8).

When water from the central water circuit flows through the water circuit (8), the rapier bar (3) may be water-cooled.

The air-guide element (10) from the first embodiment is furthermore provided with cooling ribs (25) in order to increase the cooling surface of this air-guide element (10).

The invention claimed is:

1. Guide device comprising a guide with one or more guiders for guiding a rapier bar in a rapier weaving machine, wherein this guide device is provided with an air circuit through which compressed air can flow and which is provided with perforations for cooling the rapier bar by means of compressed air, wherein the guide device is provided with a cooling circuit through which coolant can flow for cooling the rapier bar by means of coolant.

2. Guide device according to claim 1, wherein the guide comprises one or more subcircuits of the cooling circuit.

3. Guide device according to claim 1, wherein the guide extends in a longitudinal direction along a length for guiding the rapier bar and in that the guide device comprises at least one air-guiding zone (Z) in which the perforations are arranged, wherein this air-guiding zone (Z) is provided in the guide and extends over a shorter length than this length (L) of the guide, viewed in the longitudinal direction.

4. Guide device according to claim 3, wherein the cooling circuit extends along virtually the entire length (L) of the guide, viewed in the longitudinal direction.

5. Guide according to claim 1, wherein the guide comprises several guiders elements.

6. Guide device according to claim 3, wherein the guide comprises several guiders, and wherein at least one of the guiders is configured as an air-guide, in which the air-guiding zone (Z) is arranged.

7. Guide device according to claim 2, wherein the guide comprises several guiders, and wherein each guider comprises a subcircuit of the cooling circuit.

8. Guide device according to claim 7, wherein the subcircuits are mutually coupled by one or more couplings which are arranged substantially outside the guide.

9. Guide device according to claim 5, wherein the guiders are at least partly arranged one behind the other, viewed in the longitudinal direction.

10. Guide device according to claim 9, wherein at least one of the guiders is arranged in the guide device so as to be displaceable along the longitudinal direction.

11. Guide device according to claim 10, wherein the air-guide is fixedly arranged in the guide device.

12. Guide device according to claim 3, wherein the guide comprises exactly one guider which extends in the longitudinal direction along a length (L), wherein the length of the air-guiding zone (Z) is virtually half the length (L) of the guider.

13. Assembly of a rapier bar, a driver for driving this rapier bar and a guide device comprising a guide with one or more guiders for guiding this rapier bar, wherein this guide device is provided with an air circuit through which compressed air can flow and which is provided with perforations for cooling the rapier bar by means of compressed air, wherein this assembly is provided with a cooling circuit through which coolant can flow for cooling the rapier bar by means of coolant.

14. Assembly according to claim 13, wherein the cooling circuit of the assembly forms part of the guide device, and in that the guide device comprises a guide with one or more guiders for guiding a rapier bar in a rapier weaving machine, wherein this guide device is provided with an air circuit through which compressed air can flow and which is provided with perforations for cooling the rapier bar by means of compressed air, wherein the guide device is provided with a cooling circuit through which coolant can flow for cooling the rapier bar by means of coolant.

15. Assembly according to claim 13, wherein the guide device comprises a guide with one or more guiders for guiding a rapier bar in a rapier weaving machine, wherein this guide device is provided with an air circuit through which compressed air can flow and which is provided with perforations for cooling the rapier bar by means of compressed air, wherein the guide device is provided with a cooling circuit through which coolant can flow for cooling the rapier bar by means of coolant, wherein the guide extends in a longitudinal direction along a length (L) for guiding the rapier bar and in that the guide device comprises at least one air-guiding zone (Z) in which the perforations are arranged, wherein this air-guiding zone (Z) is provided in the guide and extends over a shorter length than this length (L) of the guide, viewed in the longitudinal direction, and wherein the air-guiding zone (Z) extends at least at the location of the driver.

16. Assembly according to claim 15, wherein the air-guiding zone (Z), viewed in the longitudinal direction, extends virtually along the remaining length of the guide on one side of the driver.

17. Assembly according to claim 13, wherein the guide comprises several guiders elements, at least one guider of which is a guider in which the cooling circuit partly extends and which is arranged on a side of the rapier bar which is opposite the side of the rapier bar on which the other guiders are arranged.

18. Rapier weaving machine for weaving a fabric, wherein this rapier weaving machine comprises an assembly according to claim 13.

19. Rapier weaving machine according to claim 18, wherein the guide device of the assembly of this rapier weaving machine is a guide comprises a guide with one or more guiders for guiding a rapier bar in a rapier weaving machine, wherein this guide device is provided with an air circuit through which compressed air can flow and which is provided with perforations for cooling the rapier bar by means of compressed air, wherein the guide device is provided with a cooling circuit through which coolant can flow for cooling the rapier bar by means of coolant, wherein the guide extends in a longitudinal direction along a length (L) for guiding the rapier bar and in that the guide device comprises at least one air-guiding zone (Z) in which the perforations are arranged, wherein this air-guiding zone (Z) is provided in the guide and extends over a shorter length than this length (L) of the guide, viewed in the longitudinal direction, and in that the air-guiding zone (Z) extends on the side of the fabric to be woven, at least at the end of the guide.

20. Rapier weaving machine according to claim 19, wherein the assembly comprises a rapier bar, a driver for driving this rapier bar and a guide device comprising a guide with one or more guiders for guiding this rapier bar, wherein this guide device is provided with an air circuit through which compressed air can flow and which is provided with perforations for cooling the rapier bar by means of compressed air, wherein this assembly is provided with a cooling circuit through which coolant can flow for cooling the rapier bar by means of coolant, wherein the guide device comprises a guide with one or more guiders for guiding a rapier bar in a rapier weaving machine, wherein this guide device is provided with an air circuit through which compressed air can flow and which is provided with perforations for cooling the rapier bar by means of compressed air, wherein the guide device is provided with a cooling circuit through which coolant can flow for cooling the rapier bar by means of coolant, wherein the guide extends in a longitudinal direction along a length (L) for guiding the rapier bar and in that the guide device comprises at least one air-guiding zone (Z) in which the perforations are arranged, wherein this air-guiding zone (Z) is provided in the guide and extends over a shorter length than this length (L) of the guide, viewed in the longitudinal direction, and wherein the air-guiding zone (Z) extends at least at the location of the driver, wherein the air-guiding zone (Z), viewed in the longitudinal direction, extends virtually along the remaining length of the guide on one side of the driver, and wherein said side of the driver is turned towards the fabric to be woven.

21. Rapier weaving machine according to claim 19, wherein the assembly comprises a rapier bar, a driver for driving this rapier bar and a guide device comprising a guide with one or more guiders for guiding this rapier bar, wherein this guide device is provided with an air circuit through which compressed air can flow and which is provided with perforations for cooling the rapier bar by means of compressed air, wherein this assembly is provided with a cooling circuit through which coolant can flow for cooling the rapier bar by means of coolant, wherein the guide comprises several guiders, at least one guider of which is a guider in which the cooling circuit partly extends and which is arranged on a side of the rapier bar which is opposite the side of the rapier bar on which the other guiders are arranged, and wherein the at least one guider in which the cooling circuit partly extends and which is arranged on the side of the rapier bar opposite the side of the rapier bar on which the other guiders are arranged, is arranged near the end of the guide on the side of the fabric to be woven.

* * * * *